US005916376A

United States Patent [19]

Fukuno et al.

[11] Patent Number: 5,916,376

[45] Date of Patent: Jun. 29, 1999

[54] PREPARATION OF MAGNET

[75] Inventors: Akira Fukuno; Tomomi Yamamoto; Tetsuhito Yoneyama; Tetsuya Hidaka, all of Chiba, Japan

[73] Assignee: TDK Corporation, Tokyo, Japan

[21] Appl. No.: 08/984,945

[22] Filed: Dec. 4, 1997

[30] Foreign Application Priority Data

Dec. 4, 1996 [JP] Japan ..... 8-339064

[51] Int. Cl.[6] ..... H01F 1/053

[52] U.S. Cl. ..... 148/101; 148/122; 164/423; 164/463

[58] Field of Search ..... 148/101, 102, 148/122; 164/423, 463

[56] References Cited

U.S. PATENT DOCUMENTS

| | | | |
|---|---|---|---|
| 5,209,789 | 5/1993 | Yoneyama et al. . | |
| 5,309,977 | 5/1994 | Yoneyama et al. . | |
| 5,456,769 | 10/1995 | Sakurada et al. . | |
| 5,482,573 | 1/1996 | Sakurada et al. . | |
| 5,549,766 | 8/1996 | Tsutai et al. . | |
| 5,641,363 | 6/1997 | Fukuno et al. . | |
| 5,665,177 | 9/1997 | Fukuno et al. . | |
| 5,750,044 | 5/1998 | Yoneyama et al. | 252/62.54 |

FOREIGN PATENT DOCUMENTS

| | | |
|---|---|---|
| 3-175602 | 7/1991 | Japan . |
| 7-226310 | 8/1995 | Japan . |
| 8-37122 | 2/1996 | Japan . |
| 8-81741 | 3/1996 | Japan . |
| 8-316018 | 11/1996 | Japan . |

*Primary Examiner*—John Sheehan

*Attorney, Agent, or Firm*—Oblon, Spivak, McClelland, Maier & Neustadt, P.C.

[57] ABSTRACT

An object of the invention is to provide an inexpensive magnet having a high coercivity, high squareness ratio and high maximum energy product. According to the invention, a magnet containing R, T, N, and M wherein R is at least one rare earth element with essential samarium, T is iron or iron and cobalt, and M is at least one element of Ti, V, Cr, Nb, Hf, Ta, Mo, W, Al, C, and P, with essential zirconium, in amounts of 4–8 at % of R, 10–20 at % of N, 2–10 at % of M, and having a hard magnetic phase ($TbCu_7$ type crystalline phase) and a soft magnetic phase (which is a bcc structured T phase, has an average grain diameter of 5–60 nm, and accounts for 10 to 60% by volume of the entirety), the atomic ratio (R+M)/(R+T+M) in the hard magnetic phase being in excess of 12.5%, is prepared utilizing a single roll technique. In the single roll technique, the peripheral speed of a chill roll is at least 50 m/s, and the discharge pressure of the molten alloy is 0.3–2 kgf/cm$^2$. Following quenching, the quenched alloy is subjected to heat treatment at 600–800° C. and then to nitriding treatment.

20 Claims, 2 Drawing Sheets

PREPARATION OF MAGNET

BACKGROUND OF THE INVENTION

1. Field of the Invention

This invention relates to a method for preparing rare earth nitride magnets which find main use in motors as resin bonded magnets.

2. Background of the Invention

Among high performance rare earth magnets, Sm—Co magnets and Nd—Fe—B magnets have been used in practice while active research efforts are now made to develop novel rare earth magnets.

For example, there were proposed rare earth nitride magnets of the Sm—Fe—N system in which nitrogen forms an interstitial solid solution with $Sm_2Fe_{17}$ crystals. It was reported in Paper No. S1.3 at the Sixth International Symposium on Magnetic Anisotropy and Coercivity in Rare Earth-Transition Metal Alloys, Pittsburgh, Pa., Oct. 25, 1990 (Proceedings Book: Carnegie Mellon University, Mellon Institute, Pittsburgh, Pa. 15213, USA) that the basic physical properties of $4\pi Is$=15.4 kG, Tc=470° C. and $H_A$=14 T are achievable with approximate compositions of $Sm_2Fe_{17}N_{2.3}$, that metal bonded magnets using zinc as a binder exhibit a (BH)max of 10.5 MGOe, and that the introduction of nitrogen into $Sm_2Fe_{17}$ intermetallic compounds achieves a substantial improvement in Curie temperature and hence, in thermal stability.

A variety of proposals have been made on rare earth nitride magnets (to be referred to as Sm—Fe—N magnets, hereinafter) because they are theoretically expected to exhibit characteristics surpassing Nd—Fe—B magnets. For the enhanced performance, especially high magnetization of Sm—Fe—N magnets, it is effective to increase the content of an α-Fe phase in the magnet. The content of an α-Fe phase may be increased by reducing the amount of rare earth elements in the entire magnet, and reducing the amount of rare earth elements used, in turn, has the advantage of reduced costs. However, simply reducing the amount of rare earth elements to increase the α-Fe phase detracts from coercivity, rather resulting in poorer magnet properties. Then the following proposals have been made.

(1) We proposed in U.S. Ser. No. 08/500,578 a Sm—Fe—N magnet consisting essentially of 4 to 8 at % of R, 10 to 20 at % of nitrogen, 2 to 10 at % of M, and the balance of T wherein R is at least one rare earth element, samarium accounting for the majority, M is an additive element containing zirconium as an essential component, and T is a transition metal such as iron, the magnet comprising a hard magnetic phase of $TbCu_7$ type and a soft magnetic phase consisting of a bcc structured T phase such as an α-Fe phase, the soft magnetic phase having a mean grain size of 5 to 60 nm and being present in a proportion of 10 to 60% by volume. This magnet is characterized by the essential inclusion of zirconium, the limited mean grain size of the soft magnetic phase, and the limited proportion of the soft magnetic phase in the magnet. Owing to these restrictions, a relatively high coercivity is available although good magnetization is achieved by reducing the content of rare earth elements to 8 at % or less.

(2) JP-A 81741/1996 discloses a magnet material having a composition represented by $R^1_xR^2_yT_{100-x-y-z-v}M_zN_v$ wherein $R^1$ is at least one rare earth element, $R^2$ is at least one element of zirconium, hafnium and scandium, T is at least one element of iron and cobalt, M is at least one element of Ti, V, Nb, Ta, Cr, Mo, W, Mn, Ni, Ru, Rh, Pd, Cu, Ag, Zn, Cd, Al, Ga, In, Si, Ge, Sn, and Sb, letters x, y, z and v are $2 \geqq x \geqq 20$, $0 \geqq y \geqq 15$, $2 \geqq x+y \geqq 20$, $0 \geqq z \geqq 20$, and $0.01 \geqq v \geqq 20$, expressed in at %, the magnet material having a phase having a $TbCu_7$ type crystalline structure as the major phase containing at least 90 at % of the element T. It is alleged that the saturation magnetic flux density of the major phase can be improved by containing at least 90 at % of the element T in the major phase. With respect to the α-Fe phase, it is intended to prevent the precipitation of the α-Fe phase.

The magnets of (1) exhibit properties surpassing the Nd—Fe—B magnets which have been used in the industry, but further improvements in coercivity and squareness ratio to be discussed later are desirable. The properties of the magnets of (2) are insufficient for use in spindle motors for computer hard disk drives.

SUMMARY OF THE INVENTION

An object of the invention is to provide a magnet which is inexpensive and exhibits a high coercivity, high squareness ratio and high maximum energy product.

This and other objects are attained by the construction defined below as (1) to (4).

(1) A method for preparing a magnet containing R, T, nitrogen, and M wherein R is at least one rare earth element, samarium being contained in R in a proportion of at least 50 at %, T is iron or iron and cobalt, and M is zirconium with or without partial replacement by at least one element selected from the group consisting of Ti, V, Cr, Nb, Hf, Ta, Mo, W, Al, C, and P, wherein said magnet consists essentially of 4 to 8 at % of R, 10 to 20 at % of nitrogen, 2 to 10 at % of M, and the balance of T, and has a hard magnetic phase and a soft magnetic phase, the hard magnetic phase is based on R, T, and nitrogen and contains a $TbCu_7$ type crystalline phase, the soft magnetic phase consists of a T phase of bcc structure, the soft magnetic phase has an average grain diameter of 5 to 60 nm, the content of the soft magnetic phase is 10 to 60% by volume, and the atomic ratio (R+M)/(R+T+M) in the hard magnetic phase is in excess of 12.5%, said method comprising the quenching step of obtaining a thin ribbon form of quenched alloy containing a $TbCu_7$ type crystalline phase and an amorphous phase by a single roll technique of injecting a molten alloy from a nozzle against the peripheral surface of a chill roll for rapid quenching, the heat treatment step of effecting heat treatment for crystallization on the quenched alloy in vacuum or in an inert gas atmosphere, and the nitriding step of effecting nitriding treatment on the quenched alloy after the heat treatment, wherein the peripheral speed of the chill roll in said quenching step is at least 50 m/s, the discharge pressure of the molten alloy in said quenching step is 0.3 to 2 kgf/cm$^2$, and the treating temperature in said heat treatment step is 600 to 800° C.

(2) A method for preparing a magnet according to (1) wherein the $TbCu_7$ type crystalline phase of said quenched alloy exhibits a maximum peak having a half-value width of at least 0.950 as analyzed by X-ray diffractometry using Cu—Kαradiation.

(3) A method for preparing a magnet according to (1) or (2) wherein provided that the peripheral speed of the chill roll is Vs (m/s) and the thickness of said quenched alloy is t (μm), txVs is in the range from 800 to 1300.

(4) A method for preparing a magnet according to any one of (1) to (3) wherein the atomic ratio (R+M)/(R+T+M) in the hard magnetic phase is up to 25%.

DESCRIPTION OF THE PREFERRED EMBODIMENTS

Figure 1:
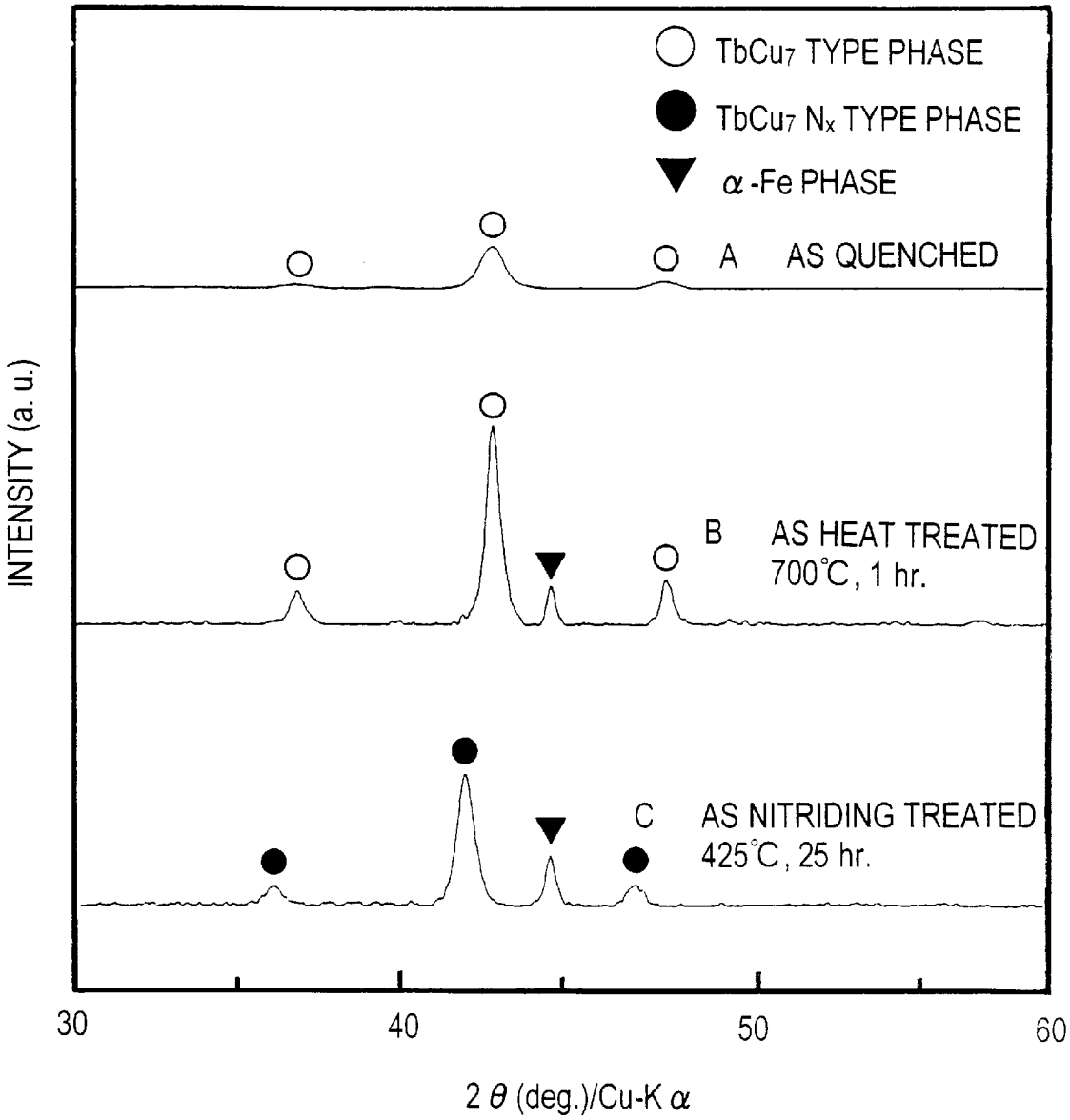
FIG. 1 is an x-ray diffraction chart of a quenched alloy, a further heat treated one, and a further nitrided one.

In a Sm—Fe—N magnet containing a $TbCu_7$ type crystalline phase as a hard magnetic phase and having a bcc structured T phase such as an α-Fe phase dispersed therein, according to the invention, the content of rare earth element R is reduced to 8 at % or less, and preparation conditions are selected such that the atomic ratio (R+M)/(R+T+M) in the hard magnetic phase may be in excess of 12.5%.

When the Curie temperature of the $TbCu_7$ type crystalline phase was measured while the magnet composition was varied, it was found that rare earth element R and element M are mainly located at Tb sites and element T is located at Cu sites in the $TbCu_7$ type crystalline phase. In the stoichiometric composition, the atomic ratio of R+M is 12.5%. That is, the invention sets such that the content of R+M in the hard magnetic phase is made higher than the stoichiometric composition. In the $TbCu_7$ type crystalline phase, it is preferable from the standpoint of magnetic anisotropy that the content of transition elements is lower than the stoichiometric content, that is, the content of R+M is higher than the stoichiometric content. As a consequence, higher coercivity is available. As opposed to prior art magnets simply having low rare earth element contents and prior art magnets in which relatively high magnetization is achieved by increasing the T content in the major phase, the magnets prepared according to the invention exhibit high coercivity despite the reduced R content in the magnets as a whole, because the content of rare earth elements in the hard magnetic phase is higher than the stoichiometric composition. In addition, magnetization is enhanced due to the high content of the bcc structured T phase in the magnets, which is favorable as magnets.

Also, the magnets prepared according to the invention exhibit a high squareness ratio and hence, a high maximum energy product. By the term "squareness ratio" used herein is meant Hk/HcJ wherein HcJ is a coercivity and Hk is the strength of an external magnetic field applied when the magnetic flux density reaches 90% of the residual magnetic flux density or remanence in the second quadrant of the magnetic hysteresis loop. With lower values of Hk, high maximum energy products are not available. Hk/HcJ becomes an index of magnet performance and represents the degree of squareness in the second quadrant of the magnetic hysteresis loop. Even with equal HcJ, magnets having greater values of Hk/HcJ are more readily magnetizable to a less variant extent and exhibit greater maximum energy products because the distribution of micrographic coercivities in the magnet becomes sharper as Hk/HcJ is greater. And these magnets are improved in the stability of magnetization against changes of an external demagnetizing field or self-demagnetizing field during use, and the performance of magnetic circuits containing the magnets becomes stable. With the magnets of the invention, Hk/HcJ values of 15% or higher are readily available, and values of 18% or higher and even values of 20% or higher are achievable. It is noted that the Hk/HcJ is usually up to about 45%. Also Hk values of 1 kOe or higher are readily available, and values of 1.5 kOe or higher and even values of 2 kOe or higher are achievable. It is noted that the Hk is usually up to about 4 kOe. The magnets of the invention may take the form of bonded magnets. The bonded magnets can produce Hk/HcJ values which are about 20 to 50% higher than the magnet powder because the distance between magnet particles becomes smaller than in the powder state.

As mentioned above, the present invention enables to realize high performance magnets at low cost because the amount of expensive rare earth elements used can be reduced, and yet a high coercivity, high squareness ratio and high maximum energy product be accomplished.

According to the invention, the content of R+M in the hard magnetic phase can be increased despite the low content of rare earth elements in the entire magnet because the conditions of the quenching step are controlled as defined above.

More particularly, according to the invention, the cooling step is tailored so as to increase both the peripheral speed of the chill roll and the discharge pressure of molten alloy. By increasing the peripheral speed of the chill roll, the thin ribbon form of alloy quenched thereby becomes thinner and is thus cooled at a higher rate. This enables the excessive localization of R+M at Tb sites of $TbCu_7$ type crystallites in the quenched alloy, leading to higher coercivity. By controlling the discharge pressure of molten alloy to the specific range defined above, the coercivity of the magnet can be higher and the squareness ratio be extremely higher. When the discharge pressure is increased, the discharge amount per unit time is accordingly increased, but that increment does not result in an increased thickness of quenched alloy for the following reason. When molten alloy is cooled by the single roll technique, recesses are created in the quenched alloy on account of the entrainment of gas from the cooling atmosphere, less tight contact with the chill roll surface, and variations of the distance between the nozzle and the chill roll due to the centrifugal whirling of the chill roll, so that the quenched alloy becomes thicker. Conversely, if the discharge pressure of molten alloy is increased, the entrainment of gas is diminished, the tight contact is improved, and the influence of centrifugal whirling of the chill roll is mitigated. As the discharge pressure is increased, the quenched alloy becomes wide spread. As a result of these, the quenched metal becomes thinner and the cooling rate is improved. Specifically, the peripheral speed of the chill roll Vs (m/s) and the thickness of the quenched alloy t (μm) are correlated to meet the equation:

$$t \times Vs = 800 \text{ to } 1300.$$

Consequently, the content of R+M in $TbCu_7$ type crystals can be higher. Also, since the contact between the molten alloy and the chill roll surface is improved by increasing the discharge pressure, the homogeneity of the quenched alloy in a thickness direction is improved. As a result, even when the peripheral speed of the chill roll is the same, the magnet is further improved in coercivity and especially in squareness ratio by increasing the discharge pressure.

The above-referred prior art example (1) (U.S. Ser. No. 08/500,578) describes that a magnet is produced by setting the peripheral speed of the chill roll at or above 50 m/s as in the present invention. However, since the quenched alloy has a thickness of about 30 μm at a peripheral speed of 50 m/s in Example of the prior application, the product txVs is equal to about 1,500, exceeding the range of the present invention. This indicates that the thickness of quenched alloy is greater than the range of the present invention. This is because the discharge pressure of molten alloy is below the range of the present invention. Under such a situation, if the peripheral speed is increased from 50 m/s, then the coercivity HcJ rises, but at a slow rate. Also in the prior application, the squareness ratio Hk/HcJ tends to rather decline as the peripheral speed increases, also because the discharge pressure of molten alloy is low. In contrast, the present invention accomplishes high performance by increasing the discharge pressure as well as increasing the peripheral speed of the chill roll, whereby the quenched alloy becomes thin and more homogeneous as compared with the event that the peripheral speed of the chill roll is simply increased. Since the present invention permits a thinner quenched alloy to be produced at an equivalent peripheral speed to the prior art, the cost of the installation can be reduced, which is advantageous in the industrial application.

The quenched alloy according to the invention has poor crystallinity due to rapid solidification, and the $TbCu_7$ type microcrystalline phase contains mechanical strains. As a result, the $TbCu_7$ type crystalline phase of the quenched alloy exhibits a maximum peak having as great a half-value width as 0.95° or more as analyzed by X-ray diffractometry using Cu—Kα radiation.

It is noted that JP-A 118815/1995 discloses a permanent magnet comprising a magnetic alloy represented by the general formula: $R^1_xR^2_yA_zCo_uFe_{100-x-y-z-u}$ wherein $R^1$ is at least one element selected from rare earth elements, $R^2$ is at least one element selected from zirconium, hafnium and scandium, A is at least one element selected from carbon, nitrogen, and phosphorus, letters x, y, z and u are $2 \geqq x$, $4 \geqq x+y \geqq 20$, $0 \geqq z \geqq 20$, and $0 \geqq u \geqq 70$, expressed in at %, wherein the magnetic alloy has a $TbCu_7$ type crystalline structure as the major phase, and in an x-ray diffraction pattern using Cu—Kα radiation (angular resolution 0.02° at most) in which the principal reflection intensity of the $TbCu_7$ type phase is $I_p$ and the principal reflection intensity of the α-Fe phase is $I_{Fe}$, the $TbCu_7$ type phase has a half-value width of the principal reflection intensity of up to 0.8° and a ratio $I_{Fe}/(I_{Fe}+I_p)$ of up to 0.4. The permanent magnet of this patent publication is analogous to the magnet of the present invention in that it has a $TbCu_7$ type major phase and an α-Fe phase.

Although Examples in which the amount of rare earth elements is 8 at % or less are found in the above-referred patent publication, the nitrogen content is below the range of the present invention, and the peripheral speed of the chill roll is 40 m/s and below the range of the present invention. It is thus estimated that these magnets must have a low squareness ratio Hk/HcJ and hence, a low maximum energy product. Moreover, these Examples in the patent publication indicate low remanence values as compared with Examples of the present invention.

In Examples in the above-referred patent publication, prior to the high-temperature (700° C.) heat treatment for enhancing coercivity, heat treatment is carried out at a low temperature (400° C.) for 4 hours in order to suppress the magnetic properties from being deteriorated by the high-temperature heat treatment. This low-temperature heat treatment is a strain-relief heat treatment for removing mechanical strains from the magnetic material. This results in the $TbCu_7$ type phase having a half-value width of the principal reflection intensity of up to 0.8°. However, as described in the present disclosure as Comparative Example, a strain-relief heat treatment can cause the ratio (R+M)/(R+T+M) of the hard magnetic phase to decline below the range of the present invention, resulting in a low HcJ and an especially low squareness ratio.

Moreover, the above-referred patent publication does not describe the content of the α-Fe phase which is restricted in the present invention. It is impossible to calculate the volume percents of both the phases from the ratio of principal reflection intensities $I_{Fe}/(I_{Fe}+I_p)$ in x-ray diffraction described in the above-referred patent publication.

Magnet textural structure

The magnet produced by the present invention contains R, T, N and M and has a composite structure containing a hard magnetic phase as the major phase and a fine soft magnetic phase.

The hard magnetic phase is based on R, T, and N and has a hexagonal $TbCu_7$ type crystalline structure, into which nitrogen has penetrated. R is located mainly at Tb sites and T is located mainly at Cu sites. M is located mainly at Tb sites, but sometimes at Cu sites, although the location of M differs with a particular element selected as M. Also, M may form a solid solution with the bcc structured T phase which is the soft magnetic phase, or form another compound with T.

The atomic ratio (R+M)/(R+T+M) in the hard magnetic phase is in excess of 12.5%, preferably at least 13.5%. Too low (R+M)/(R+T+M) results in a low coercivity and a low squareness ratio Hk/HcJ. The upper limit of (R+M)/(R+T+M) is preferably 25%, more preferably 20%. With too high (R+M)/(R+T+M), the creation of a $TbCu_7$ type crystalline structure is retarded and instead, a $Th_2Zn_{17}$ type crystalline structure develops, failing to provide a high coercivity and a high squareness ratio.

The soft magnetic phase is a T phase of bcc structure and is considered as consisting essentially of an α-Fe phase or an α-Fe phase whose iron is partially replaced by Co, M, R, etc.

To provide a high coercivity, the soft magnetic phase should have an average grain diameter of 5 to 60 nm. It is believed that in the magnet where there are present a hard magnetic phase having high crystal magnetic anisotropy and a soft magnetic phase having high saturation magnetization, when the soft magnetic phase is very fine, more interfaces are available between the two phases and the exchange interaction becomes more strong, resulting in a higher coercivity. If the soft magnetic phase has a too smaller average grain diameter, then the saturation magnetization becomes low. A too large average grain diameter results in a low coercivity and a low squareness ratio. The preferred average grain diameter of the soft magnetic phase is 5 to 40 nm.

The soft magnetic phase is generally amorphous, which can be ascertained by means of a transmission electron microscope. The average grain diameter of the soft magnetic phase is determined by the analysis of an image of a magnet section. First, with respect to a soft magnetic phase contained in an observation region of a magnet section, the number of crystal grains (n) and the sum of the cross-sectional areas of crystal grains (S) are determined by image analysis. Then the average cross-sectional area per crystal grain (S/n) of the soft magnetic phase is calculated. The diameter D of a circle having an area equal to S/n is the average grain diameter. That is, the average grain diameter D is determined according to the equation:

$$\pi(D/2)^2=S/n.$$

It is noted that the observation region is preferably set so that n is 50 or more.

The average grain diameter of the hard magnetic phase is preferably 5 to 500 nm, more preferably 5 to 100 nm. If the average grain diameter of the hard magnetic phase is too small, the phase becomes insufficiently crystalline to provide a high coercivity. Conversely, a too large average grain diameter of the hard magnetic phase tends to prolong the time taken for nitriding treatment. The average grain diameter of the hard magnetic phase is determined as is the average grain diameter of the soft magnetic phase.

The content of the soft magnetic phase in the magnet is 10 to 60% by volume, preferably 10 to 36% by volume. When the content of the soft magnetic phase is too high or too low, satisfactory magnet properties are not available and especially, the maximum energy product becomes low. The content of the soft magnetic phase is determined by the well-known areal analysis using a transmission photomicrograph of a magnet section, wherein the cross-sectional area ratio gives a volume ratio.

Understandably, the magnet may contain a phase or phases other than the above-mentioned hard and soft magnetic phases. Although zirconium is located at Tb sites of the $TbCu_7$ type phase which is the hard magnetic phase, it may form another compound such as $Fe_3Zr$. However, since the presence of a different phase such as a $Fe_3Zr$ phase is undesirable for permanent magnets, the content of a zirconium-containing different phase should preferably be less than 5% by volume of the magnet.

Reason of limitation of magnet composition

Described below is the reason of limitation of the magnet composition.

The content of R is 4 to 8 at %, preferably 4 to 7 at %. The content of nitrogen is 10 to 20 at %, preferably 12 to 18 at %, more preferably from more than 15 at % to 18 at %, most preferably 15.5 to 18 at %. The content of M is 2 to 10 at %, preferably 2.5 to 5 at %. The remainder is essentially T.

If the R content is too low, coercivity is low. If the R content is too high, the amount of bcc structured T phase decreases to deteriorate magnet properties and the use of a more amount of expensive R prohibits manufacture of an inexpensive magnet. In addition to samarium (Sm), the R which can be used herein is at least one element of Y, La, Ce, Pr, Nd, Eu, Gd, Tb, Dy, Ho, Er, Tm, Yb, and Lu. The hard magnetic phase in the magnet of the invention has a $TbCu_7$ type crystalline structure, with nitrogen occupying interstitial sites, and a hard magnetic phase of such construction exhibits maximum crystal magnetic anisotropy when R is samarium. Samarium should be present in a proportion of at least 50 at %, preferably at least 70 at % of R because crystal magnetic anisotropy and coercivity become low if the proportion of Sm is lower.

If the nitrogen content is too low, there occur an insufficient increase of Curie temperature and insufficient improvements in coercivity, squareness ratio, saturation magnetization, and maximum energy product. If the nitrogen content is too high, remanence tends to lower, and squareness ratio and maximum energy product become low. The nitrogen content may be measured by gas analysis or the like.

Element M is added for establishing the fine composite structure mentioned above. Absent element M, coarse crystal grains of the soft magnetic phase precipitate during preparation of an alloy, failing to provide high coercivity even if the soft magnetic phase eventually has a relatively small mean grain size. If the M content is too low, it is difficult to produce a magnet in which the soft magnetic phase has a small mean grain size. If the M content is too high, saturation magnetization is low. M is zirconium or zirconium which is partially replaced by at least one element selected from the group consisting of Ti, V, Cr, Nb, Hf, Ta, Mo, W, Al, C, and P. The preferred element substituting for part of zirconium is at least one of aluminum, carbon and phosphorus, with the aluminum being especially preferred. Zirconium is essential in the practice of the invention because it is especially effective for textural structure control and squareness ratio improvement. Also, since aluminum is effective for facilitating the nitriding of a quenched alloy, the addition of aluminum can shorten the time required for nitriding treatment. Note that the zirconium content of the magnet is preferably 2 to 4.5 at %, more preferably 3 to 4.5 at %. This stands both when only zirconium is used as M and when zirconium is used with another element(s) as M. If the Zr content is too low, both high coercivity and high squareness ratio are not available. If the Zr content is too high, saturation magnetization and remanence are low.

With the above-mentioned elements excluded from the magnet, the remainder is essentially T. T is iron or a mixture of iron and cobalt. Although the addition of cobalt is effective for improving magnet properties, the proportion of cobalt in T is preferably up to 50 at %. If the proportion of cobalt exceeds 50 at %, remanence would be low.

It is understood that the magnet may contain oxygen as an incidental impurity. Since the magnet is based on rare earth-transition metal compounds, oxidation inevitably occurs during handling or during treatments in the respective steps. When rapid quenching, pulverization, or heat treatment for controlling the textural structure, to be described later, is carried out in an argon atmosphere, for example, the presence of about 1 ppm of oxygen in the atmosphere argon is incidental and as a result, less than about 6,000 ppm of oxygen is contained in the magnet. As another incidental impurity, there is contained about 500 ppm or less of carbon originating from organic matter. There is also contained less than about 100 ppm of hydrogen originating from hydroxide which forms from reaction of airborne moisture with the magnet. Moreover, there are contained less than about 5,000 ppm of aluminum, silicon, magnesium, etc. originating from the crucible material.

X-ray diffraction

The magnet according to the invention on analysis by X-ray diffractometry using Cu—Kα radiation preferably has an $I_S/I_H$ value of 0.4 to 2.0, more preferably 0.7 to 1.8 wherein $I_H$ is the intensity of a maximum peak of the $TbCu_7$ type crystalline phase which is the hard magnetic phase and $I_S$ is the intensity of a maximum peak of the soft magnetic phase. The magnet exhibits a higher squareness ratio with $I_S/I_H$ in the range of 0.4 to 2.0, and a further higher squareness ratio with $I_S/I_H$ in the range of 0.7 to 1.8. With $I_S/I_H$ outside the range, the magnet tends to have a lower maximum energy product.

Preparation process

Next, the method for preparing the magnet according to the present invention is described.

The method involves preparing a quenched alloy containing R, T, and M by a single roll technique, subjecting the quenched alloy to heat treatment for textural structure control, and then subjecting to nitriding treatment for converting into a magnet.

In the single roll technique, a thin ribbon form of quenched alloy is obtained by injecting a molten alloy from a nozzle against the peripheral surface of the chill roll, thereby rapidly cooling the molten alloy. As compared with other liquid quenching techniques, the single roll technique has high mass productivity and good reproducibility of quenching conditions. The material of the chill roll is not critical although it is often preferred to use copper or copper alloys.

According to the invention, the peripheral speed of the chill roll is set equal to or above 50 m/s, preferably equal to or above 60 m/s. Such a high peripheral speed ensures that (R+M)/(R+T+M) is high as defined above. Also, the quenched alloy becomes a microcrystalline state containing an amorphous phase, which permits the subsequent heat treatment to develop grains of any desired grain diameter and facilitates nitriding. In addition, the thin ribbon form of quenched alloy becomes thinner, ensuring that the quenched alloy be more homogeneous. Consequently, there is obtained a magnet having a high coercivity, high remanence, high squareness ratio and high maximum energy product. It is often preferable that the roll peripheral speed is up to 120 m/s. If the roll peripheral speed is too high, inefficient contact would occur between the molten alloy and the roll peripheral surface, failing to achieve effective heat transfer. This retards the effective cooling rate.

Provided that the peripheral speed of the chill roll is Vs (m/s) and the thickness of the thin ribbon form of quenched alloy is t ($\mu$m), txVs is preferably in the range from 800 to 1,300, and more preferably from 850 to 1,200. With too small values of txVs, it would be difficult to consistently produce the quenched alloy, resulting in inconsistent properties. In the case of a thin ribbon form of quenched alloy with a too large value of txVs, it is difficult to acquire a sufficient cooling rate appropriate for the peripheral speed of the chill roll and hence, to produce a magnet having an improved coercivity and squareness ratio.

The textural structure of quenched alloy is preferably a composite structure which contains crystallites of $TbCu_7$ type and an amorphous phase and may further contain a bcc structured T phase. The presence of the bcc structured T phase is ascertainable by X-ray diffractometry as the presence of a peak of that phase or by thermal analysis as the extinction of magnetization at a temperature corresponding to the Curie temperature of the $\alpha$-Fe phase.

When analyzed by X-ray diffractometry using Cu—K$\alpha$ radiation, the $TbCu_7$ type crystalline phase of the quenched alloy exhibits a maximum peak having a half-value width of preferably at least 0.95°, more preferably at least 1.05°. If this half-value width is too narrow, the content of R+M in the hard magnetic phase would become too low, failing to achieve the benefits of the present invention. A greater half-value width suggests low crystallinity and is favorable for the present invention. However, since seed crystals are necessary for crystallization to proceed during the heat treatment, a too greater half-value width, that is, too low crystallinity is unfavorable. For this reason, the half-value width is preferably at most 1.50°.

Heat treatment is effected on the quenched alloy for controlling its textural structure. This heat treatment is to permit the bcc structured T phase having a specific average grain diameter to precipitate. The temperature of this heat treatment is preferably 600 to 800° C., more preferably 650 to 775° C., and the treating time is usually about 10 minutes to about 4 hours although it depends on the treating temperature. This heat treatment is preferably performed in an inert atmosphere such as argon or helium or vacuum. The heat treatment induces precipitation of a fine bcc structured T phase and even precipitation of a $TbCu_7$ type crystalline phase. At too low heat treatment temperatures, less amounts of the bcc structured T phase would precipitate whereas at too high heat treatment temperatures, M and T would form compounds such as $Fe_3Zr$ to detract from properties.

The quenched alloy should preferably have an $I_S/I_H$ value of up to 0.4, more preferably up to 0.25, further preferably up to 0.15. As previously described, $I_H$ is the intensity of a maximum peak of the $TbCu_7$ type crystalline phase and $I_S$ is the intensity of a maximum peak of the soft magnetic phase. By setting a low $I_S/I_H$ value immediately after quenching and increasing the $I_S/I_H$ value through heat treatment in this way, that is, by effecting heat treatment so as to promote the precipitation of a bcc structured T phase, the fine bcc structured T phase can be effectively dispersed in the structure to readily establish excellent magnet properties.

The method of the present invention need not involve an independent heat treatment step for strain relief as described in the above-referred JP-A 118815/1995. Conversely, if strain relief heat treatment at about 400° C. is carried out as described in that patent publication, the half-value width of a maximum peak of the $TbCu_7$ type crystalline phase is undesirably reduced. Specifically, effecting such a strain relief heat treatment can cause the $TbCu_7$ type crystal phase, which is the hard magnetic phase, to assume a (R+M)/(R+T+M) value of 12.5% or less, thus failing to provide a high coercivity and high squareness ratio.

After the heat treatment for textural structure control, the quenched alloy is subject to nitriding treatment. For the nitriding treatment, the quenched alloy is heat treated in a nitrogen gas atmosphere. This treatment causes nitrogen atoms to penetrate into crystals of $TbCu_7$ type to form an interstitial solid solution, yielding a hard magnetic phase. During the nitriding treatment, the treating temperature is preferably 350 to 700° C., more preferably 350 to 600° C. and the treating time is preferably 0.1 to 300 hours. The pressure of nitrogen gas is preferably at least about 0.1 atm. For the nitriding treatment, high pressure nitrogen gas, a mixture of nitrogen gas and hydrogen gas, or ammonia gas may also be used.

The shape of the magnet is not critical and may be either a thin ribbon or a granular shape. When applied to magnet articles such as bonded magnets, the magnet is pulverized into magnet particles having a desired particle size. The pulverizing step may be carried out after the rapid quenching, after the heat treatment for textural structure control, or after the nitriding treatment, and the pulverizing step may be divided into plural stages.

For the bonded magnet application, the magnet particles preferably have a mean particle size of at least 10 $\mu$m. The mean particle size should preferably be at least 30 $\mu$m, more preferably at least 50 $\mu$m, most preferably at least 70 $\mu$m in order to insure satisfactory oxidation resistance. A particle size of this order ensures that a bonded magnet having a high density is obtained. No upper limit is imposed on the mean particle size although it is usually up to about 1,000 $\mu$m, preferably up to 250 $\mu$m. It is to be noted that the mean particle size used herein means a weight average particle size $D_{50}$ as determined by sieving. The weight average particle size $D_{50}$ is the particle size determined by accumulating the weight of particle fractions from one having a smaller diameter until the accumulated weight reaches 50% of the total weight of the entire particles.

A bonded magnet is prepared by binding magnet particles with a binder. The magnet of the present invention is applicable to either compression bonded magnets relying on press molding or injection bonded magnets relying on injection molding. The binder used herein is preferably selected from various resins while metal binders may be used to form metal bonded magnets. The type of resin binder is not critical and may be properly selected for a particular purpose from thermosetting resins such as epoxy resins and nylon and thermoplastic resins. Also the type of metal binder is not critical. Also, no limits are imposed on the proportion of the binder relative to the magnet particles and various molding conditions including pressure, which may be suitably selected from conventional ranges. Understandably, a method requiring high-temperature heat treatment should preferably be avoided in order to prevent enlargement of crystal grains.

EXAMPLE

Examples of the present invention are given below by way of illustration.

Example 1

Comparison in terms of M content, additive elements, and soft magnetic phase content Magnet powders as shown in Table 1 were prepared.

First, alloy ingots were formed by melting and crushed into pieces. The pieces were placed in a quartz nozzle where they were melted by RF induction heating into a molten alloy, which was quenched by the single roll technique, yielding a quenched alloy in ribbon form. The chill roll used was a Be—Cu roll and the discharge pressure of the molten alloy was 0.6 kgf/cm$^2$. The thickness t of the quenched alloy, the peripheral speed Vs of the chill roll, and txVs are reported in Table 1. On analysis by X-ray diffractometry and a transmission electron microscope, the quenched alloys were found to have a polycrystalline composite structure containing a $TbCu_7$ type crystalline phase and an α-Fe phase of bcc structure and further contain an amorphous phase. In each of the quenched alloys, the $TbCu_7$ type crystals had maximum peak half-value width values of 0.95 to 1.20°, which fall within the range of the invention.

Next, the quenched alloy was subject to heat treatment for textural structure control in an argon gas atmosphere. The heat treatment was performed at 700° C. for one hour. On analysis by X-ray (Cu—Kα radiation) diffractometry and a transmission electron microscope after the heat treatment, the alloy was found to be a polycrystalline composite structure containing a $TbCu_7$ type crystalline phase and an α-Fe phase of bcc structure while the amorphous phase substantially disappeared.

Next, the crystallized alloy was pulverized to a size of less than about 150 μm and subject to nitriding treatment in a nitrogen gas atmosphere of 1 atm. at 425° C., yielding a magnet powder. For each magnet powder, the nitriding treatment time was 20 hours.

The quenched alloys used in the manufacture of the respective magnet powders had $I_S/I_H$ values of 0.03 to 0.21 and the magnets resulting from the nitriding treatment of the quenched alloys had $I_S/I_H$ values of 0.25 to 1.2.

For each of the magnet powders, the average grain diameter of the α-Fe phase and the content of the α-Fe phase in the magnet powder were determined by partial composition analysis (TEM-EDX) using a transmission electron microscope. The results are shown in Table 1.

These magnet powders were measured for composition, (R+M)/(R+T+M) of the hard magnetic phase, remanence (Br), coercivity (HcJ), and squareness ratio (Hk/HcJ). The composition was determined by fluorescent X-ray analysis. The nitrogen content was determined by gas analysis. The results are shown in Table 1.

TABLE 1

Comparison in terms of M content, additive elements and soft magnetic phase content; discharge pressure 0.6 kgf/cm$^2$

| Magnet powder | Composition (at %) | | | | Vs | t | | α-Fe Grain diameter | α-Fe Content | (R + M)/(R + T + M) | Br | HcJ | Hk/HcJ |
|---|---|---|---|---|---|---|---|---|---|---|---|---|---|
| No. | Sm | Co | M | N | (m/s) | (μm) | t × Vs | (nm) | (vol %) | (at %) | (kG) | (kOe) | (%) |
| 101 | 6.5 | — | 3.5Zr + 1.5Al | 15 | 55 | 20 | 1100 | 33 | 16 | 14.0 | 9.0 | 10.5 | 26 |
| 102 | 6.7 | — | 3.2Zr + 0.5V | 15 | 70 | 12 | 840 | 25 | 26 | 16.2 | 9.4 | 11.2 | 27 |
| 103 | 5.5 | 10 | 4.0Zr | 12 | 60 | 20 | 1200 | 28 | 24 | 13.5 | 10.0 | 7.8 | 30 |
| 104 | 6.0 | 5 | 3.5Zr | 15 | 60 | 19 | 1140 | 25 | 22 | 15.0 | 9.7 | 9.5 | 28 |
| 105** | 7.0 | — | —* | 10 | 60 | 19 | 1140 | 200* | 35 | 11.5* | 7.5 | 0.8 | 12 |

*outside the limited range
**comparative example

The benefits of the invention are evident from the results shown in Table 1. More particularly, the magnet powders containing element M and having an average grain diameter of α-Fe phase within the specific range exhibit high coercivities despite the low R contents. In contrast, M-free magnet powder No. 105, due to a (R+M)/(R+T+M) value outside the range of the invention and a too large crystal diameter of α-Fe phase, exhibits extremely low values of coercivity and squareness ratio. With a squareness ratio Hk/HcJ below 15%, the magnet experiences substantial changes of magnetization in response to slight changes of the external demagnetizing field and self-demagnetizing field during its use so that the performance of the magnetic circuit containing the magnet becomes unstable.

It is noted that in the respective magnet powders, the $TbCu_7$ type crystalline phase as the major phase had an average grain diameter of about 10 to 100 nm.

Example 2

Comparison in terms of R content and soft magnetic phase content

Magnet powders as shown in Table 2 were prepared. The preparation conditions were the same as used for the magnet powers in Example 1 except that the discharge pressure of molten alloy was 0.35 kgf/cm$^2$, the heat treatment for textural structure control was carried out at 675 to 725° C. for 15 minutes to 2 hours, the alloy as heat treated was pulverized to a diameter of less than about 105 μm, and the nitriding treatment was carried out for 25 hours.

In each of the quenched alloys, the $TbCu_7$ type crystals had maximum peak half-value width values of 0.95 to 1.20°, which fall within the range of the invention. As exemplary charts of X-ray diffraction using Cu—Kα radiation, FIG. 1 shows charts of the quenched alloy used in the preparation of magnet powder No. 202, the same after heat treatment, and the same after nitriding treatment.

These magnet powders were measured as in Example 1. he results are shown in Table 2.

TABLE 2

Comparison in terms of R content and soft magnetic phase content; discharge pressure 0.35 kgf/cm$^2$

| Magnet powder | Composition (at %) | | | | Vs | t | | α-Fe Grain diameter | α-Fe Content | (R + M)/(R + T + M) | Br | HcJ | Hk/HcJ |
|---|---|---|---|---|---|---|---|---|---|---|---|---|---|
| No. | Sm | Co | M | N | (m/s) | (μm) | t × Vs | (nm) | (vol %) | (at %) | (kG) | (kOe) | (%) |
| 201** | 3.3* | 5 | 2.2Zr | 10 | 70 | 13 | 910 | 45 | 63* | 15.0 | 5.3 | 2.5 | 8 |
| 202 | 4.5 | — | 4.0Zr | 14 | 70 | 16 | 1120 | 25 | 43 | 15.2 | 10.5 | 6.5 | 24 |
| 203 | 7.8 | 5 | 3.8Zr | 15 | 70 | 16 | 1120 | 30 | 32 | 17.8 | 9.8 | 10.5 | 29 |
| 204** | 9.5* | — | 4.5Zr | 17 | 70 | 18 | 1260 | 20 | 5* | 15.8 | 6.0 | 13.0 | 27 |

*outside the limited range
**comparative example

It is evident from Table 2 that when the R content is 4 to 8 at % and the content of soft magnetic phase is 10 to 60% by volume, especially high remanence values and high squareness ratios are available. These magnet powders also exhibited high maximum energy products.

It is noted that in the respective magnet powders, the $TbCu_7$ type crystalline phase as the major phase had an average grain diameter of about 10 to 100 nm.

Example 3

Comparison in terms of Sm content in R

Magnet powders of the composition shown in Table 3 were prepared. The preparation conditions were the same as used for the magnet powers in Example 2 except that the discharge pressure of molten alloy was 0.7 kgf/cm$^2$.

In each of the quenched alloys, the $TbCu_7$ type crystals had maximum peak half-value width values of 1.00 to 1.10°, which fall within the range of the invention.

These magnet powders were measured as in Example 1. The results are shown in Table 3.

It is evident from Table 3 that high properties are obtained when the content of Sm in R (Sm+Nd in Table 3) is at least 50 at %.

TABLE 3

Comparison in terms of Sm content in R; discharge pressure 0.7 kgf/cm$^2$

| Magnet powder | Composition (at %) | | | | Vs | t | | α-Fe Grain diameter | α-Fe Content | (R + M)/(R + T + M) | Br | HcJ | Hk/HcJ |
|---|---|---|---|---|---|---|---|---|---|---|---|---|---|
| No. | Sm | Nd | M | N | (m/s) | (μm) | t × Vs | (nm) | (vol %) | (at %) | (kG) | (kOe) | (%) |
| 301 | 7.5 | — | 3.6Zr | 16 | 75 | 14 | 1050 | 22 | 25 | 15.7 | 10.0 | 10.5 | 28 |
| 302 | 5.5 | 2 | 3.8Zr | 16 | 75 | 14 | 1050 | 21 | 21 | 14.5 | 9.5 | 6.5 | 24 |
| 303** | 3.5% | 4% | 3.5Zr | 15 | 75 | 14 | 1050 | 23 | 12 | 12.6 | 6.2 | 2.8 | 14 |

*outside the limited range
**comparative example

It is noted that in the respective magnet powders, the $TbCu_7$ type crystalline phase as the major phase had an average grain diameter of about 10 to 100 nm.

Example 4

Comparison in terms of N content

Magnet powders of the composition shown in Table 4 were prepared. The preparation conditions were the same as used for the magnet powers in Example 2 except that the discharge pressure of molten alloy was 0.8 kgf/cm$^2$. The conditions of nitriding treatment were changed in the ranges of treating temperature 450 to 480° C. and treating time 1 to 20 hours.

In each of the quenched alloys, the $TbCu_7$ type crystals had maximum peak half-value width values of 1.05 to 1.10°, which fall within the range of the invention.

These magnet powders were measured as in Example 1. The results are shown in Table 4.

TABLE 4

Comparison in terms of N content; discharge pressure 0.8 kgf/cm$^2$

| Magnet powder | Composition (at %) | | | | Vs | t | | α-Fe Grain diameter | α-Fe Content | (R + M)/(R + T + M) | Br | HcJ | Hk/HcJ |
|---|---|---|---|---|---|---|---|---|---|---|---|---|---|
| No. | Sm | Co | M | N | (m/s) | (μm) | t × Vs | (nm) | (vol %) | (at %) | (kG) | (kOe) | (%) |
| 401** | 6.8 | 4 | 4.2Zr | 8 | 68 | 16 | 1088 | 38 | 23 | 15.0 | 7.5 | 5.5 | 9 |
| 402 | 6.8 | 4 | 4.2Zr | 12 | 68 | 16 | 1088 | 38 | 23 | 15.0 | 9.7 | 8.5 | 24 |
| 403 | 6.8 | 4 | 4.2Zr | 17 | 68 | 16 | 1088 | 38 | 23 | 15.0 | 10.1 | 11.0 | 31 |
| 404** | 6.8 | 4 | 4.2Zr | 26* | 68 | 16 | 1088 | 38 | 20 | 15.0 | 8.5 | 8.2 | 13 |

*outside the limited range
**comparative example
No. 404 used ammonia gas for nitridation.

It is evident from Table 4 that high properties, especially high squareness ratios are obtained when the N content is from 10 to 20 at %, especially from 12 to 18 at %, further from more than 15 at % to 18 at %. These magnet powders also exhibited high maximum energy products.

It is noted that in the respective magnet powders, the $TbCu_7$ type crystalline phase as the major phase had an average grain diameter of about 10 to 100 nm.

Example 5

Comparison-1 in terms of discharge pressure of molten alloy

Magnet powders of the composition shown in Table 5 were prepared. The preparation conditions were the same as in Example 1 except that the discharge pressure of molten alloy was as reported in Table 5, and the heat treatment for textural structure control was carried out at 750° C. for one hour.

Of the quenched alloys, the quenched alloy resulting in magnet powder No. 501 showed a maximum peak half-value width of the $TbCu_7$ type crystals of 0.85° which is below the range of the invention while the remaining alloys showed half-value width values of 0.95 to 1.10° which fall in the range of the invention.

These magnet powders were measured as in Example 1. The results are shown in Table 5.

TABLE 5

Comparison in terms of discharge pressure of alloy melt

| Magnet powder | Composition (at %) | | | | Vs | t | | α-Fe Grain diameter | α-Fe Content Content | (R + M)/(R + T + M) | Br | HcJ | Hk/HcJ | Discharge pressure |
|---|---|---|---|---|---|---|---|---|---|---|---|---|---|---|
| No. | Sm | Co | M | N | (m/s) | (μm) | t × Vs | (nm) | (vol %) | (at %) | (kG) | (kOe) | (%) | (kgf/cm$^2$) |
| 501** | 7.0 | 5 | 3.7Zr | 14 | 60 | 26 | 1560* | 35 | 20 | 13.5 | 9.8 | 8.5 | 27 | 0.2* |
| 502 | 7.0 | 5 | 3.7Zr | 14 | 60 | 21 | 1260 | 32 | 18 | 15.5 | 9.8 | 10.0 | 27 | 0.3 |
| 503 | 7.0 | 5 | 3.7Zr | 13 | 60 | 20 | 1200 | 35 | 31 | 16.5 | 9.8 | 10.5 | 28 | 0.6 |
| 504 | 7.0 | 5 | 3.7Zr | 13 | 60 | 18 | 1080 | 38 | 31 | 17.5 | 10.0 | 11.2 | 30 | 1.5 |
| 505** | 7.0 | 5 | 3.7Zr | 13 | 60 | 17 | 1020 | 36 | 31 | 17.5 | 9.9 | 11.1 | 30 | 2.5* |

*outside the limited range
**comparative example

It is evident from Table 5 that magnet powder No. 501 shows a low squareness ratio Hk/HcJ because a discharge pressure of molten alloy below the range of the invention allows the quenched alloy to become thick to give a too large value of txVs.

In the manufacture of magnet powder No. 505, the molten alloy splashed on account of a too high discharge pressure, so that only less than about 5% of the discharge amount formed a thin ribbon, which is practically unacceptable.

It is noted that in the respective magnet powders, the $TbCu_7$ type crystalline phase as the major phase had an average grain diameter of about 10 to 100 nm.

Example 6

Comparison-2 in terms of discharge pressure of molten alloy

Figure 2A:
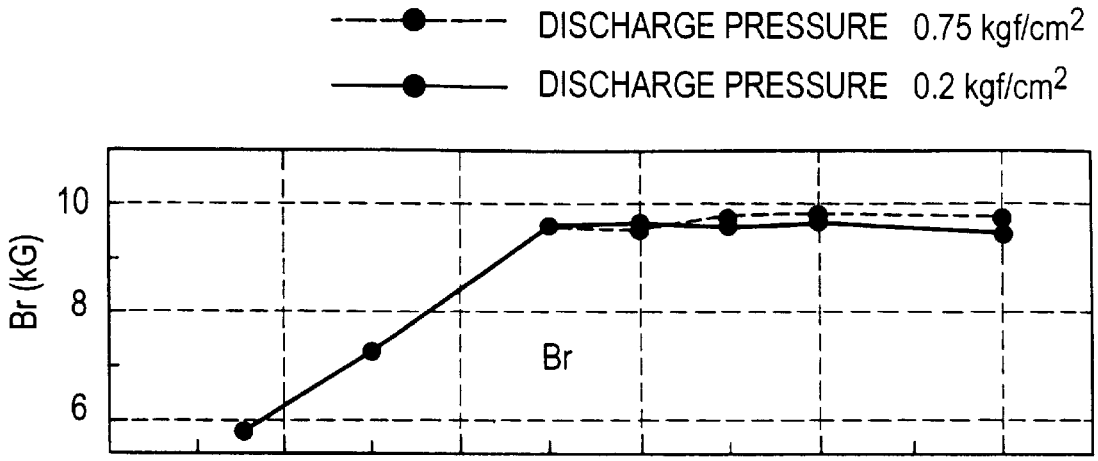
FIGS. 2A, 2B and 2C are graphs showing magnet properties relative to the peripheral speed of a chill roll.
Figure 2B:
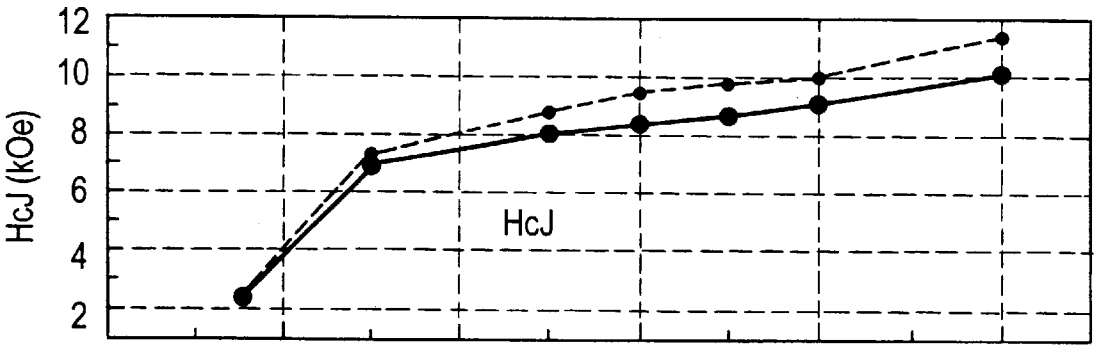
Figure 2C:
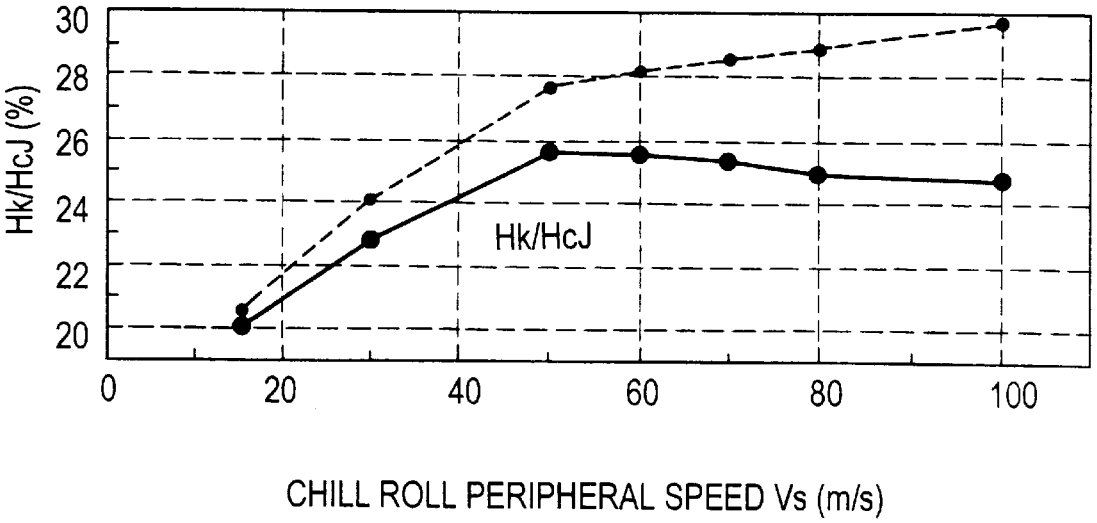

It was examined how magnet properties were affected by the discharge pressure and the peripheral speed of a chill roll during quenching of molten alloy. Quenched alloys were formed under the conditions that the alloy composition was the same as magnet powder No. 104 in Table 1, the discharge pressure was 0.2 kgf/cm$^2$ or 0.75 kgf/cm$^2$, and the peripheral speed of a chill roll was changed as shown in FIGS. 2A, 2B, and 2C. The subsequent steps were the same as in Example 11 in the above-referred U.S. Ser. No. 08/500,578. In this way, there were prepared magnet powders, which were measured for Br, HcJ, and Hk/HcJ. The results are shown in FIGS. 2A, 2B, and 2C. In FIGS. 2A, 2B, and 2C, the values of magnetic properties connected by solid lines correspond to a discharge pressure of 0.2 kgf/cm$^2$, and the values of magnetic properties connected by broken lines correspond to a discharge pressure of 0.75 kgf/cm$^2$.

As seen from FIGS. 2A, 2B, and 2C, the magnet powders obtained when the discharge pressure is within the range of the invention are superior in most of magnetic properties to the magnet powders obtained when the discharge pressure is below the range of the invention. Especially, improvements in HcJ and Hk/HcJ are remarkable and the extent of improvement is significantly expanded when the peripheral speed of a chill roll exceeds 50 m/s. It is evident from these results that the benefits of the invention are achieved by a combination of an increased peripheral speed of a chill roll with an optimum discharge pressure of molten alloy.

Strain relief heat treatment described in JP-A 118815/1995

The quenched alloy used in the manufacture of magnet powder No. 203 in Table 2 was subjected to a heat treatment similar to the strain relief heat treatment described in JPA 118815/1995. The treating temperature was 400° C. and the treating time was 30 minutes. After the heat treatment, the maximum peak half-value width of the $TbCu_7$ type phase was 0.45°. Thereafter, the quenched alloy was subjected to heat treatment for textural structure control at 700° C. for one hour, causing an α-Fe phase to precipitate. The quenched alloy was further subjected to nitriding treatment as magnet powder No. 203, obtaining magnet powder No. 203-2. A comparison of magnet powder No. 203 with No. 203-2 is shown in Table 6.

range of the invention because of the strain relief heat treatment. This results in a low HcJ and a markedly low squareness ratio.

Example 7

Comparison in terms of chill roll peripheral speed (Bonded magnet)

A bonded magnet containing a magnet powder of the composition shown in Table 7 was mixed with an epoxy resin, press molded, and heat treated for curing into a compression bonded magnet. The epoxy resin was used in an amount of 2 to 3 parts by weight per 100 parts by weight of the magnet powder. During the press molding, the pressure holding time was 10 seconds and the applied pressure was 10,000 kgf/cm$^2$. The heat treatment for resin curing was at 150° C. for one hour.

The preparation conditions of the magnet powders were the same as the magnet powders in Example 2 except that the peripheral speed of a chill roll was as shown in Table 7 and the discharge pressure of molten alloy was 0.5 kgf/cm$^2$.

These bonded magnets were measured for magnetic properties as in Example 1. The results are shown in Table 7. The maximum peak half-value width values of the $TbCu_7$ type crystals of the quenched alloys are shown in Table 7.

TABLE 6

Comparison between magnets with or without strain relief heat treatment

| Magnet powder | Composition (at %) | | | | Vs | t | | Strain relief heat | α-Fe Grain diameter | α-Fe Content | (R + M)/(R + T + M) | Br | HcJ | Hk/HcJ |
|---|---|---|---|---|---|---|---|---|---|---|---|---|---|---|
| No. | Sm | Co | M | N | (m/s) | (μm) | t × Vs | treatment | (nm) | (vol %) | (at %) | (kG) | (kOe) | (%) |
| 203-2** | 7.8 | 4 | 3.8Zr | 10 | 70 | 16 | 1120 | done* | 30 | 3* | 10.5* | 9.2 | 5.5 | 12 |
| 203 | 7.8 | 5 | 3.8Zr | 15 | 70 | 16 | 1120 | no | 30 | 32 | 17.8 | 9.8 | 10.5 | 29 |

*outside the limited range
**comparative example

As seen from Table 6, in magnet powder No. 203-2, the (R+M)/(R+T+M) of the hard magnetic phase is below the

TABLE 7

Bonded Magnets: Comparison in terms of chill roll peripheral speed and $TbCu_7$ type phase main peak half-value width; discharge pressure 0.5 kgf/cm$^2$

| Bonded magnet | Composition (at %) | | | | Vs | t | | α-Fe Grain diameter | α-Fe Content | (R + M)/(R + T + M) | Br | HcJ | Hk/HcJ | Half-value width |
|---|---|---|---|---|---|---|---|---|---|---|---|---|---|---|
| No. | Sm | Co | M | N | (m/s) | (μm) | t × Vs | (nm) | (vol %) | (at %) | (kG) | (kOe) | (%) | (° C.) |
| 1** | 7.2 | 2 | 3.7Zr | 13 | 30* | 45 | 1350* | 160* | 3* | 11.5* | 6.5 | 6.8 | 24 | 0.50* |
| 2 | 7.2 | 2 | 3.7Zr | 15 | 55 | 19 | 1045 | 45 | 18 | 13.5 | 7.1 | 9.2 | 30 | 0.98 |
| 3 | 7.2 | 2 | 3.7Zr | 15 | 75 | 12 | 900 | 25 | 22 | 14.5 | 7.3 | 10.9 | 32 | 1.02 |
| 4 | 6.5 | 4 | 3.5Zr + 0.3Al | 16 | 90 | 9 | 810 | 18 | 33 | 16.2 | 7.8 | 8.9 | 32 | 1.13 |

*outside the limited range
**comparate example

It is evident from Table 7 that when the peripheral speed of a chill roll is below the range of the invention, the maximum peak half-value width values of the $TbCu_7$ type phase are below the range of the invention and consequently, the (R+M) content in the $TbCu_7$ type phase is below the stoichiometric composition, resulting in an extremely low HcJ.

It is noted that in the respective magnet powders, the $TbCu_7$ type crystalline phase as the major phase had an average grain diameter of about 10 to 100 nm.

The benefits of the invention are evident from the foregoing Examples.

We claim:

1. A method for preparing a magnet containing R, T, nitrogen, and M, wherein R is at least one rare earth element, wherein R contains at least 50 at % of samarium, T is iron or iron and cobalt, and M is zirconium with or without partial replacement by at least one element selected from the group consisting of Ti, V, Cr, Nb, Hf, Ta, Mo, W, Al, C, and P, wherein said magnet consists essentially of 4 to 8 at % of R, 10 to 20 at % of nitrogen, 2 to 10 at % of M, and the balance of T, and has a hard magnetic phase and a soft magnetic phase, wherein the hard magnetic phase is based on R, T, and nitrogen and has a $TbCu_7$ crystal structure, wherein the soft magnetic phase consists of a phase of T having bcc structure, the soft magnetic phase has an average grain diameter of 5 to 60 nm, the content of the soft magnetic phase is 10 to 60% by volume, and wherein the atomic ratio (R+M)/(R+T+M) in the hard magnetic phase is in excess of 0.125, said method comprising:

quenching a melt containing R, T and M by a single roll technique of injecting a molten alloy from a nozzle against the peripheral surface of a chill roll to obtain a quenched molten alloy in the form of a thin ribbon containing a crystalline phase having a $TbCu_7$ crystal structure and an amorphous phase, heat treating the quenched alloy in vacuum or in an inert gas atmosphere, and nitriding the heat treated and quenched alloy, wherein the peripheral speed of the chill roll in said quenching step is at least 50 m/s, the discharge pressure of the molten alloy in said quenching step is 0.3 to 2 kgf/cm$^2$, and the treating temperature in said heat treatment step is 600 to 800° C.

2. A method for preparing a magnet according to claim 1, wherein the crystalline phase having a $TbCu_7$ crystal structure in said quenched alloy exhibits a maximum peak having a half-value width of at least 0.95° as analyzed by X-ray diffractometry using Cu—Kα radiation.

3. A method for preparing a magnet according to claim 1, wherein when the peripheral speed of the chill roll is Vs (m/s) and the thickness of said quenched alloy is t (μm), txVs is from 800 to 1300.

4. A method for preparing a magnet according to claim 1, wherein the atomic ratio (R+M)/(R+T+M) in the hard magnetic phase is up to 0.25.

5. A method for preparing a magnet according to claim 1, wherein R further comprises at least one element selected from the group consisting of Y, La, Ce, Pr, Nd, Eu, Gd, Tb, Dy, Ho, Er, Tm, Yb and Lu.

6. A method for preparing a magnet according to claim 1, wherein R contains at least 70 at % of samarium.

7. A method for preparing a magnet according to claim 1, wherein the peripheral speed of the chill roll in said quenching step is at least 60 m/s.

8. A method for preparing a magnet according to claim 1, wherein the peripheral speed of the chill roll in said quenching step is up to 120 m/s.

9. A method for preparing a magnet according to claim 1, wherein the temperature in said heat treating step is 650 to 775° C.

10. A method for preparing a magnet according to claim 1, wherein the nitriding step is conducted at 350 to 700° C.

11. A method for preparing a magnet according to claim 1, wherein the nitriding step is conducted at 350 to 600° C.

12. A method for preparing a magnet according to claim 1, wherein the nitriding step is conducted for 0.1 to 300 hours.

13. The process of claim 5, further comprising pulvrezing the thin ribbon to produce magnet particles.

14. The process of claim 13, wherein the magnet particles have a mean particle size of at least 10 μm.

15. The process of claim 14, wherein the magnet particles have a mean particle size of up to about 1000 μm.

16. The process of claim 13, wherein the magnet particles have a mean particle size of at least 30 μm.

17. The process of claim 13, wherein the magnet particles have a mean particle size of at least 50 μm.

18. The process of claim 13, wherein the magnet particles have a mean particle size of at least 70 μm.

19. The process of claim 13, further comprising binding the magnet particles with a binder to produce a bonded magnet.

20. The process of claim 19, wherein the binder is a resin or a metal.

* * * * *

UNITED STATES PATENT AND TRADEMARK OFFICE

CERTIFICATE OF CORRECTION

PATENT NO. : 5,916,376
DATED : June 29, 1999
INVENTOR(S) : Akira FUKUNO et al.

It is certified that error appears in the above-identified patent and that said Letters Patent is hereby corrected as shown below:

Column 20, line 34, "claim 5" should read --claim 1--;
line 34, "pulvrezing" should read --pulverizing--.

Signed and Sealed this

Eighteenth Day of April, 2000

*Attest:*

Q. TODD DICKINSON

*Attesting Officer*

*Director of Patents and Trademarks*